US007364444B2

(12) United States Patent
Kellock et al.

(10) Patent No.: US 7,364,444 B2
(45) Date of Patent: Apr. 29, 2008

(54) SHUTTERED ELECTRICAL CONNECTOR SOCKET

(75) Inventors: Andrew Kellock, Mitcham (AU); Quentin David Cook, Strathmore (AU)

(73) Assignee: Clipsal Australia Pty Ltd., Bowden (AU)

( * ) Notice: Subject to any disclaimer, the term of this patent is extended or adjusted under 35 U.S.C. 154(b) by 0 days.

(21) Appl. No.: 10/571,541

(22) PCT Filed: Sep. 10, 2004

(86) PCT No.: PCT/AU2004/001222

§ 371 (c)(1),
(2), (4) Date: Jun. 9, 2006

(87) PCT Pub. No.: WO2005/025007

PCT Pub. Date: Mar. 17, 2005

(65) Prior Publication Data

US 2007/0037421 A1 Feb. 15, 2007

(30) Foreign Application Priority Data

Sep. 11, 2003 (AU) ..... 2003904963

(51) Int. Cl.
*H01R 13/44* (2006.01)

(52) U.S. Cl. ..... 439/138; 439/140; 439/676

(58) Field of Classification Search ..... 439/138, 439/140, 142, 136, 676
See application file for complete search history.

(56) References Cited

U.S. PATENT DOCUMENTS

| | | | | |
|---|---|---|---|---|
| 4,188,082 | A | 2/1980 | Dickey | |
| 4,666,225 | A | 5/1987 | Hampton et al. | |
| 4,713,016 | A | 12/1987 | Kato | |
| 5,224,868 | A | 7/1993 | Tseng | |
| 5,634,802 | A * | 6/1997 | Kerklaan | 439/131 |
| 5,679,013 | A * | 10/1997 | Matsunaga et al. | 439/144 |
| 5,964,600 | A * | 10/1999 | Miles et al. | 439/140 |
| 6,142,834 | A * | 11/2000 | Liao | 439/676 |
| 6,154,597 | A | 11/2000 | Roth | |
| 6,287,133 | B1 * | 9/2001 | Yang | 439/138 |
| 6,375,480 | B1 | 4/2002 | Chen et al. | |
| 6,409,549 | B1 * | 6/2002 | Yeh | 439/676 |

(Continued)

FOREIGN PATENT DOCUMENTS

EP 0457425 11/1991

(Continued)

*Primary Examiner*—Hien Vu
(74) *Attorney, Agent, or Firm*—Greenblum & Bernstein, P.L.C.

(57) ABSTRACT

A shuttered electrical connector for receiving an electrical plug, the plug having a hinged tail for lockingly engaging with the connector, is disclosed. The connector includes: a body 20 defining a socket having 22 an open mouth 24; a central shutter 30 hingedly mounted to the body 20 adjacent the open mouth 24 for rotation about a first hinge axis 32; and a pair of spaced apart side shutters 40 & 50 hingedly mounted to the body 20 adjacent the open mouth 24 for rotation about a second hinge axis 42, the second hinge axis 42 parallel to and spaced apart from the first hinge axis 32. The shutters are rotatable through approximately 90 degrees from: a closed position in which together they cover the open mouth 24 while presenting a substantially flat outer face, to an open position receiving the plug in which the central shutter is offset from the side shutters.

22 Claims, 6 Drawing Sheets

U.S. PATENT DOCUMENTS

| | | | | |
|---|---|---|---|---|
| 6,482,019 | B1 * | 11/2002 | Lo Forte et al. | 439/131 |
| 6,971,921 | B1 * | 12/2005 | Lai | 439/676 |
| 2002/0058432 | A1 | 5/2002 | Chen et al. | |
| 2004/0142589 | A1 | 7/2004 | Caveney | |

FOREIGN PATENT DOCUMENTS

| | | |
|---|---|---|
| FR | 2723268 | 2/1996 |
| GB | 2260035 | 3/1993 |

* cited by examiner

SHUTTERED ELECTRICAL CONNECTOR SOCKET

FIELD OF THE INVENTION

The present invention relates to electrical connectors and in particular to electrical connector sockets having shutters.

BACKGROUND OF THE INVENTION

Electrical connectors such as data outlets have used shutters for many years to minimise the ingress of dust, grime, grease, condensation and other contaminants. The shutter is usually biased by a spring to bias it towards closure. Alternatively, some shutters are closed by gravity. When a plug is inserted in the socket, the shutter is driven away from the plug by rotation or linear movement.

Shuttered RJ45 sockets can be grouped into two types: front plate assembled shutters and modular sockets with integral shutters.

With front plate assembled shutters, the shutter is part of the front plate assembly, hence much more room is available to fit the shutter. Typically, shutters slide upwards behind the front plate with a spring or gravity return. A disadvantage for this shutter arrangement is the limited numbers of sockets that can be fixed to the front plate due to the room needed for the shutter movement.

Modular sockets with integral shutters tend to be more compact. The modular socket can also be fitted to many different applications, as the shutter is part of the socket itself. This arrangement allows for the most number of sockets per front plate. A disadvantage with this arrangement is the complexity of the design due to very small spaces available and the shape and need to meet strict standard requirements for dimensions.

Modular outlet shutter types can also be broken down into two groups: linear push in types and rotating shutters.

Linear shutters are pushed into the socket when the plug is inserted. This type of shutter has slots in its front face to allow the contact arms to pass through the shutter when the plug is being fitted. The shutter runs in slots and typically has a complicated spring arrangement to keep the shutter parallel with the plug to prevent jamming. A problem with this design is the need for slots in the front face of the shutter. The slots provide a path allowing contaminants to enter the socket. This type of design usually has the shutter recessed to meet the socket dimension requirements when completely pushed in.

Rotating shutters provide a better dust cover arrangement than the linear version, as no slots are required. The problem with this type of shutter is a messy look. The shutter's front face requires a large recess with catch surfaces to catch the plug's locking tab when inserted. The shutter catch surfaces also protrudes out of the module again to provide the appropriate shape to accommodate the RJ45 plug when the shutter has rotated it to its fully inserted position.

It is an object of the invention to provide an electrical connector with an improved shutter arrangement.

SUMMARY OF THE INVENTION

According to a first aspect of the invention there is provided a shuttered electrical connector for receiving an electrical plug, the plug having a hinged tail for lockingly engaging with the connector, the connector including:

a body defining a socket having an open mouth;

a central shutter hingedly mounted to the body adjacent the open mouth for rotation about a first hinge axis; and a pair of spaced apart side shutters hingedly mounted to the body adjacent the open mouth for rotation about a second hinge axis, the second hinge axis parallel to and spaced apart from the first hinge axis, wherein the shutters are rotatable through approximately 90 degrees from: a closed position in which together they cover the open mouth while presenting a substantially flat outer face, to an open position receiving the plug in which the central shutter is offset from the side shutters.

Preferably the central shutter is T-shaped having a central leg through which the first hinge axis passes.

Preferably the connector includes infill portions mounted to the body and positioned one on each side of the central leg, wherein, when the shutters are in the closed position, the infill portions assist in covering the mouth of the socket, and when the shutters are in the open position, the infill portions present abutment surfaces to assist in retaining the plug.

Preferably the shutters and the infill portions are parts of a single plastic moulded sub-frame having necked regions, the necked regions functioning as hinges for the shutters.

Preferably the connector includes a spring biasing the shutters towards the closed position.

Preferably the spring actuates the central shutter to the closed position and the central shutter actuates the side shutters to the closed position.

Preferably the central shutter includes at least two projecting wings, the wings positioned such that, as the central shutter closes under actuation from the spring, they bear against the side shutters thereby closing them.

Preferably each side shutter includes a stop, each stop engagable with the body to limit rotation of the shutters from the open position to the closed position.

Preferably the spring comprises folded sheet metal having an end lip engaging the central shutter, a curved portion, a cantilever portion and an anchor portion engaging the body.

Preferably the connector is arranged and constructed such that the spring anchor portion rotates about a mounting point on the body, whereby rotation of the spring anchor portion reduces the stresses that would otherwise be applied to the spring.

Preferably the central shutter has a cleaning material attached to an end remote from the first hinge axis, the cleaning material provided to clean electrical contacts when the shutter rotates past the contacts.

According to a second aspect of the invention there is provided a shuttered electrical connector for receiving an electrical plug, the plug having a hinged tail for lockingly engaging with the connector, the connector including:

a body defining a socket having an open mouth;

a central shutter hingedly mounted to the body adjacent the open mouth for rotation about a first hinge axis;

a pair of spaced apart side shutters hingedly mounted to the body adjacent the open mouth for rotation about a second hinge axis, the second hinge axis parallel to and spaced apart from the first hinge axis; and a spring biasing the shutters towards the closed position, wherein the shutters are rotatable through approximately 90 degrees from: a closed position in which together they cover the open mouth while presenting a substantially flat outer face, to an open position receiving the plug in which the central shutter is offset from the side shutters.

Preferably the spring actuates the central shutter to the closed position and the central shutter actuates the side shutters to the closed position.

Preferably the central shutter includes at least two projecting wings, the wings positioned such that, as the central shutter closes under actuation from the spring, they bear against the side shutters thereby closing them.

Preferably each side shutter includes a stop, each stop engagable with the body to limit rotation of the shutters from the open position to the closed position.

Preferably the spring comprises folded sheet metal having an end lip engaging the central shutter, a curved portion, a cantilever portion and an anchor portion engaging the body.

Preferably the connector is arranged and constructed such that the spring anchor portion rotates about a mounting point on the body, whereby rotation of the spring anchor portion reduces the stresses that would otherwise be applied to the spring.

Preferably the central shutter has a cleaning material attached to an end remote from the first hinge axis, the cleaning material provided to clean electrical contacts when the shutter rotates past the contacts.

According to a third aspect of the invention there is provided a shuttered electrical connector for receiving an electrical plug, the plug having a hinged tail for lockingly engaging with the connector, the connector including:

a body defining a socket having an open mouth;

a central shutter hingedly mounted to the body adjacent the open mouth for rotation about a first hinge axis, the central shutter having a pair of spaced apart protrusions positioned adjacent the first hinge axis;

a pair of spaced apart side shutters hingedly mounted to the body adjacent the open mouth for rotation about a second hinge axis, the second hinge axis parallel to and spaced apart from the first hinge axis, wherein the shutters are rotatable through approximately 90 degrees from: a closed position in which together they cover the open mouth while presenting a substantially flat outer face, to an open position receiving the plug in which the central shutter is offset from the side shutters and wherein the protrusions present and abutment surfaces to assist in retaining the plug.

Preferably the connector includes a spring biasing the shutters towards the closed position.

Preferably the spring actuates a first of the side shutters to the closed position, the first side shutter actuates the central shutter to the closed position and the central shutter actuates a second of the side shutters to the closed position.

Preferably the central shutter has a cleaning material attached to an end remote from the first hinge axis, the cleaning material provided to clean electrical contacts when the shutter rotates past the contacts.

Specific embodiments of the invention will now be described in some further detail with reference to and as illustrated in the accompanying figures. These embodiments are illustrative and are not meant to be restrictive of the scope of the invention.

DETAILED DESCRIPTION OF PREFERRED EMBODIMENTS OF THE INVENTION

Preferred embodiments of the invention are illustrated in the accompanying representations in which:

FIGS. 1*a* and 1*b* show a perspective view of a shuttered electrical connector in accordance with a first embodiment of the invention with the shutters in closed and open positions respectively.

Figure 1A:
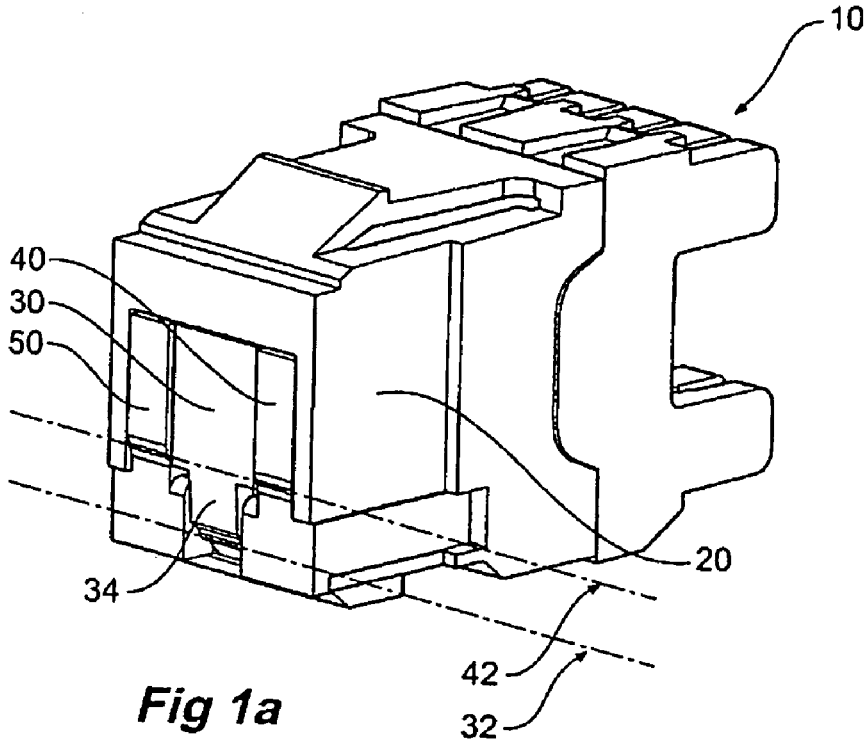
Figure 1B:
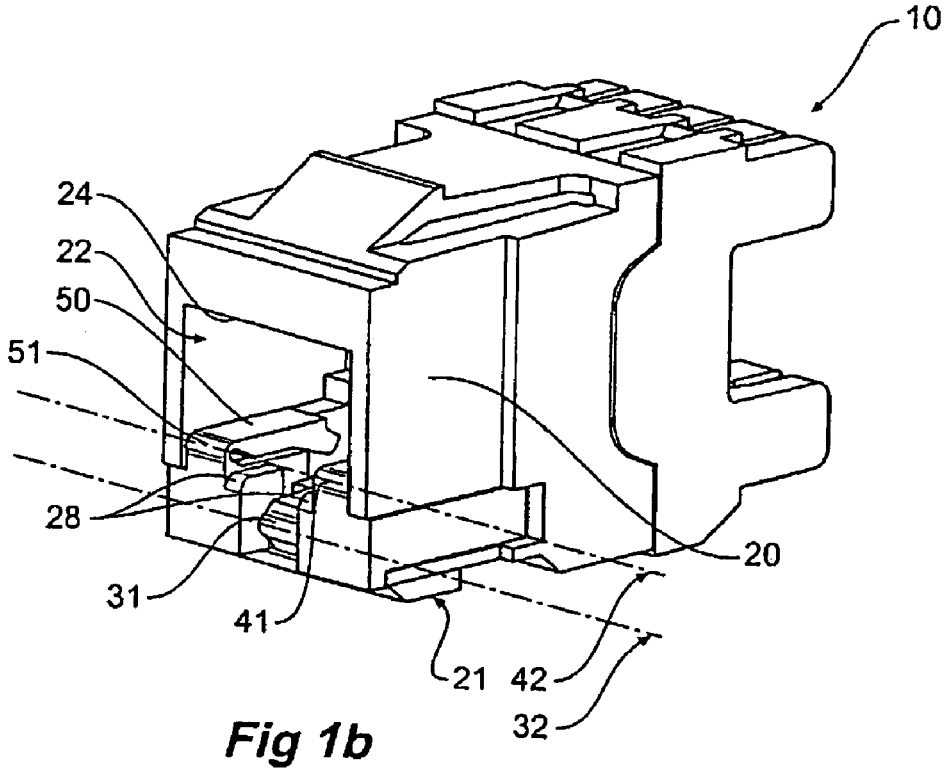
Figure 5A:
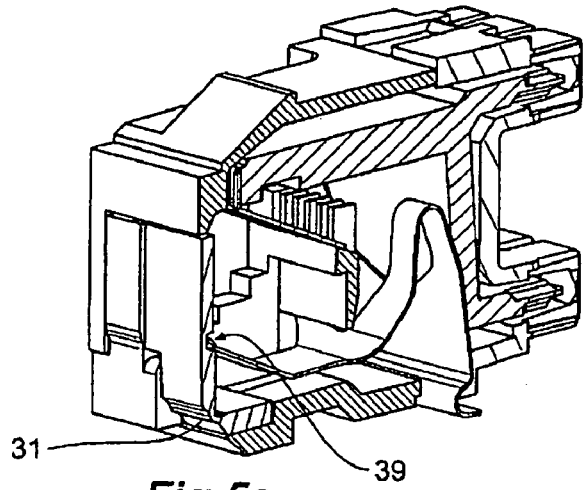
Figure 5B:
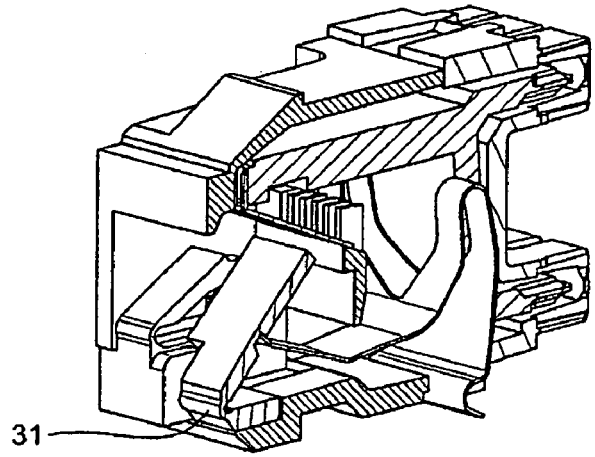
Figure 5C:
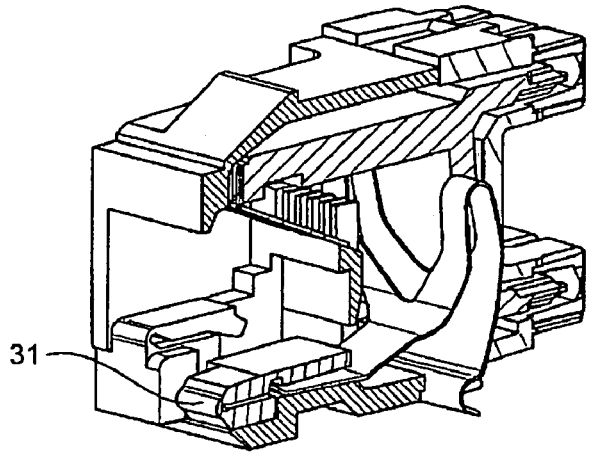

FIGS. 5*a*, 5*b* and 5*c* are similar views to those of FIGS. 1*a* and 1*b* showing the shutters progressively opening in cut-away perspective views.

Figure 6A:
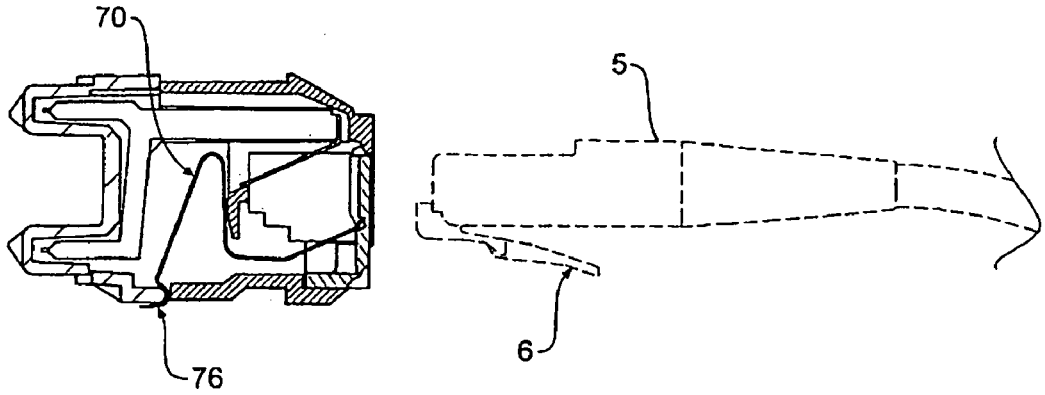
Figure 6B:
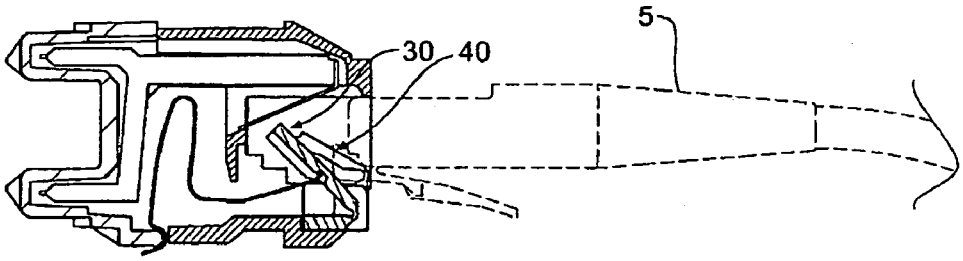
Figure 6C:
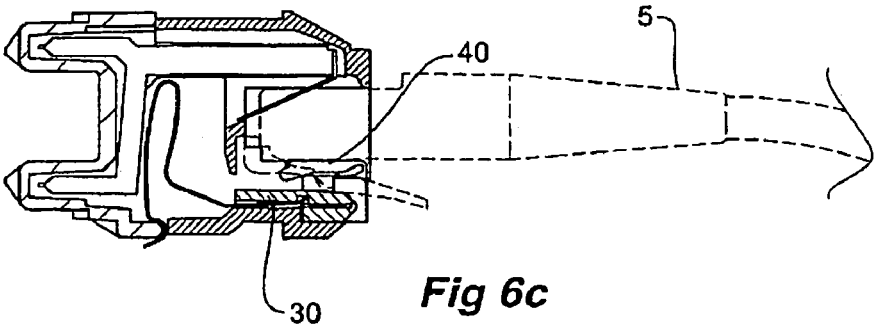

FIGS. 6*a*, 6*b* and 6*c* show the connector of FIGS. 5*a*, 5*b* and 5*c* in a cut-away side view.

Figure 7A:
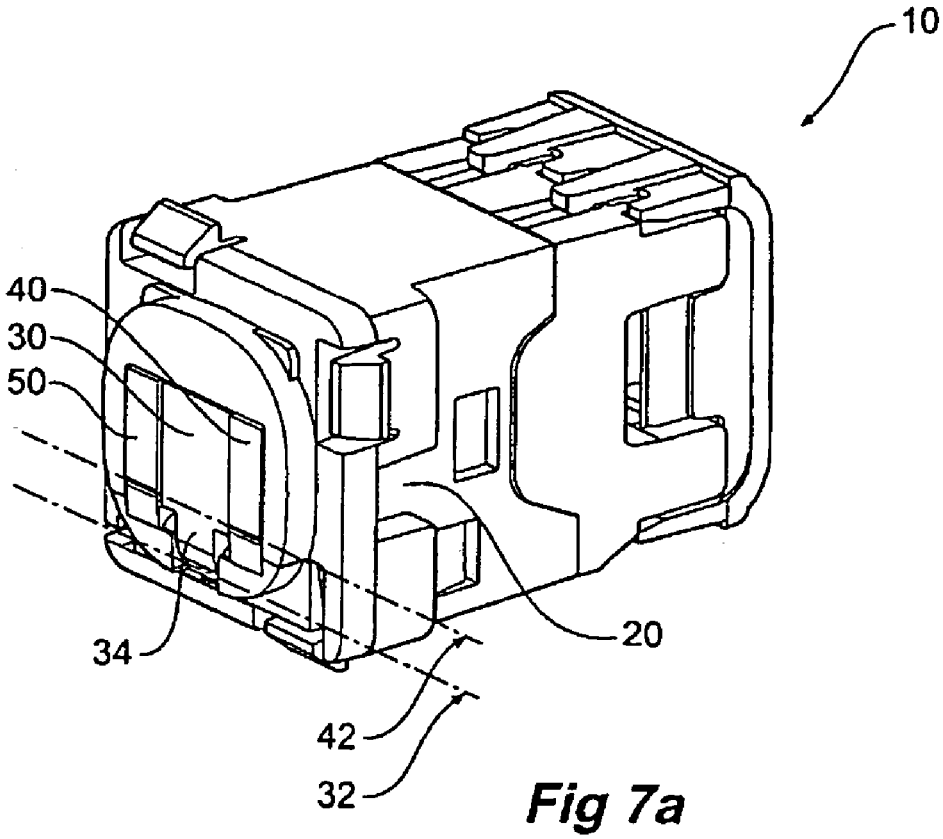
Figure 7B:
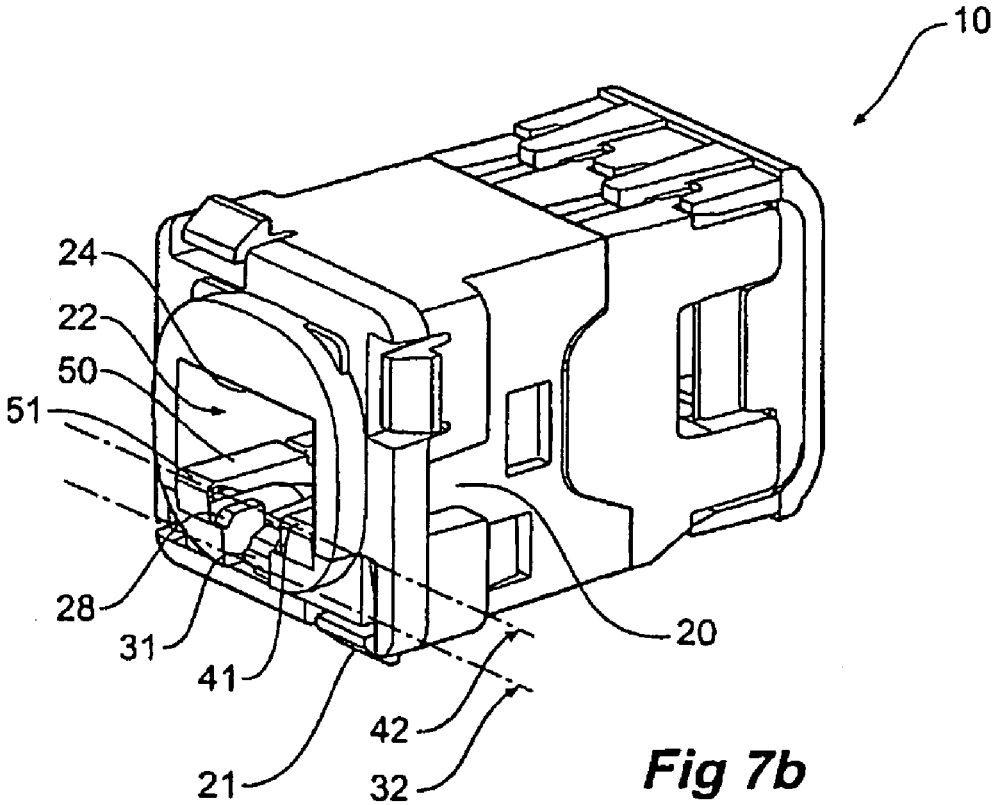

FIGS. 7*a* and 7*b* are similar views to FIGS. 1*a* and 1*b*, but show the embodiment with a more rounded front face.

Figure 8:
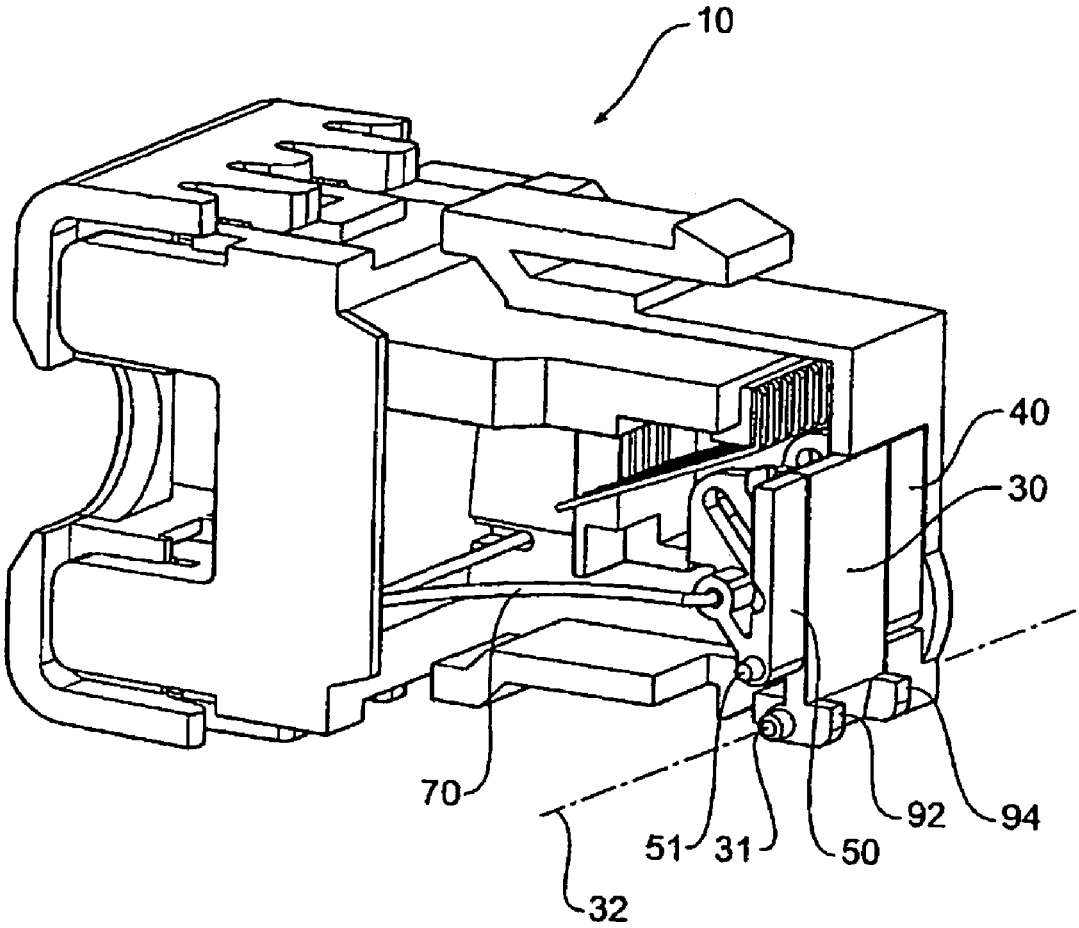

FIG. 8 is a cut-away perspective view of a connector according to a second embodiment of the invention.

In the embodiment shown in FIGS. 1*a* and 1*b*, a shuttered electrical connector 10 has a body 20 which defines a socket 22 having an open mouth 24. As can be seen from FIG. 1*b*, the socket 22 is shaped to receive a RJ45 style plug 5 such as that shown in FIG. 6*a*. RJ45 style plugs are fitted with a hinged tail 6 for lockingly engaging the plug to its connector.

The connector 10 has a central shutter 30 hingedly mounted to the body 20 adjacent the open mouth 24 for rotation about a first hinge axis 32. A pair of spaced apart side shutters 40 and 50 are also hingedly mounted to the body 20 at a point adjacent the open mouth 24 for rotation about a second hinge axis 42. The second hinge axis 42 is parallel to and spaced apart from the first hinge axis 32. The separation of the hinge axis 32 and 42 is such that the shutters are movable through approximately 90 degrees from a closed position in which together they cover the open mouth as is shown in FIG. 1*a*, to an open position in which the central shutter is offset from the side shutters as is shown in FIG. 1*b*. In the closed position shown in FIG. 1*a*, the three shutters present a substantially flat outer face giving a clean appearance to the overall connector 10.

The shutters 30, 40 and 50 connect to the body 20 at body sub-frame 21 by integral hinges 31, 41 and 51 respectively as shown in FIG. 1*b*. This greatly simplifies manufacture and assembly. In other embodiments of the invention, other hinge arrangements may be used.

The positioning of the side shutters 40 and 50, on an axis parallel to but offset from the axis of the central shutter 30, allows the shutters to match the specified internal dimensions of an RJ45 socket outlet as dictated in National International Standards when in their open position as shown in FIG. 1*b*. This arrangement can also be used to provide specified internal dimensions of plugs of other standards (other than RJ45). The central shutter hinge axis 32 is positioned such that a large recess area is not required where it would be required with a single pivot shutter mechanism. Thus, the front face of the connector assembly 10 is essentially flat when the shutters 30, 40 and 50 are closed as is shown in FIG. 1*a*.

Figure 2:
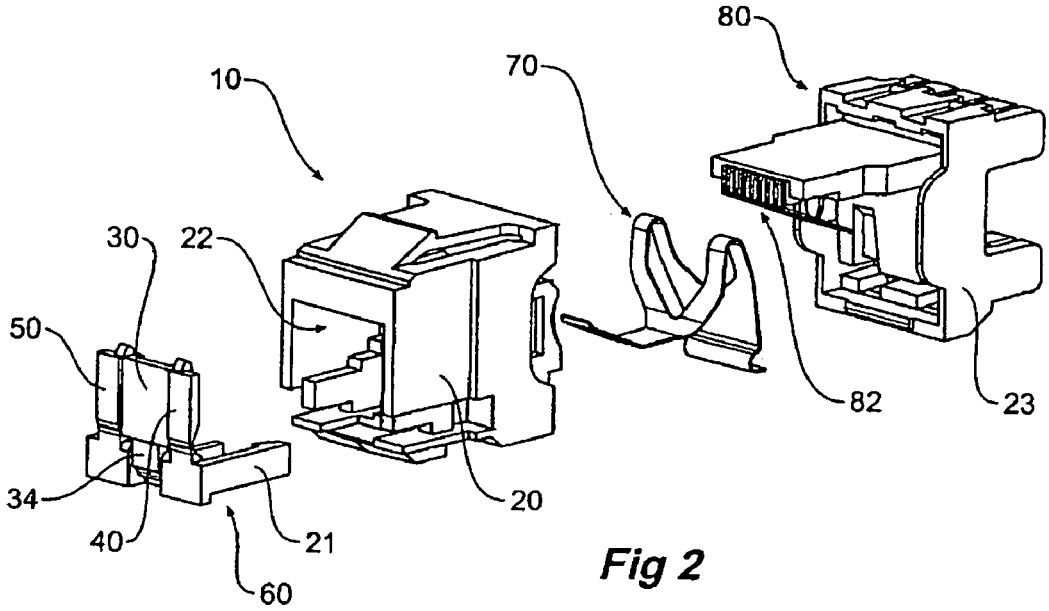
FIG. 2 shows the connector of FIG. 1*a* in an exploded view.

The various components and sub-components of the connector 10 are clearly illustrated in the exploded view of FIG. 2. This figure shows that with the preferred embodiment of the invention, the connector 10 includes a separable shutter sub-assembly 60 having a body sub-frame 21. The sub-frame 21 supports the central shutter 30 and the adjacent side shutters 40 and 50. The connector 10 also includes a rear contact sub-assembly 80 having a rear frame 23 that supports contacts 82. A spring 70, most clearly shown in FIG. 3, is provided to bias the shutters to a closed position.

The central shutter 30 is T-shaped having a central leg 34 through which the first hinge axis 32 passes as is most clearly shown in FIG. 1*a*. A pair of infill portions 28, more easily seen in FIG. 1*b*, are mounted to the body 21 one each side of the central leg 34. More specifically, with this embodiment of the invention, the infill portions 28 are part of the sub-frame 21. The infill portions 28 assist in covering the mouth 24 of the socket 22 when the shutters 30, 40 and 50 are in the closed position. Furthermore, infill portions 28 present abutment surfaces to assist in retaining the plug 5 when the shutters 30, 40 and 50 are in their open position as is shown in FIGS. 1*b*, 5*c* and 6*c*.

Referring to FIG. 5 it can be seen that spring 70 is provided to bias the shutters into a closed position. Spring 70 has been designed to operate in an efficient and effective manner in a very restricted space. The spring 70 offers good closing force to shut the triple shutters 30, 40 and 50 and overcome any friction caused by cleaning of the contacts but is also such that it is unstressed when the shutters are in their open position. This is important because much of the operating life of the connector will be with a plug inserted into it. A poorly designed spring will be overstressed and will fail to close the shutters when its plug is removed.

Figure 3:
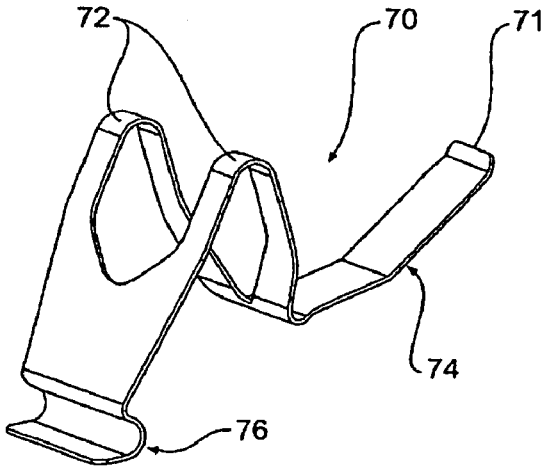
FIG. 3 shows a spring component of the connector shown in FIG. 2.

As can be seen in FIG. 3, the spring 70 can be punched and formed from sheet metal into a shape similar to a question mark. FIGS. 6*a* through to 6*c* show that only two points of the spring, its end lip 71 and its anchor portion 76, come into contact with the body 20 and the central shutter 30. The central shutter has a slot 39 that receives the spring end lip 71 as is shown in FIG. 5*a*. When the central shutter 30 is closed the spring 70 is essentially being compressed at its curved portion 72. This provides a closed preload bias. When the shutters open, the spring anchor portion 76 is allowed to rotate to greatly reduce the stress being applied to the spring 70. The rotation also changes the overcentre point which is important to prevent the shutter 30 staying in the open position. The spring 70 has a cantilever portion 74 which functions as a cantilever spring as the curved portion 72 becomes more closed. When the shutters are completely open, that is when the plug 5 is inserted, the spring 70 is in a low state of stress as the cantilever portion 74 is in a relatively relaxed condition and the curved portion 72 has been rotated to minimise the force in this area. However, the spring 70 has been held so that it doesn't go over centre.

Figure 4:
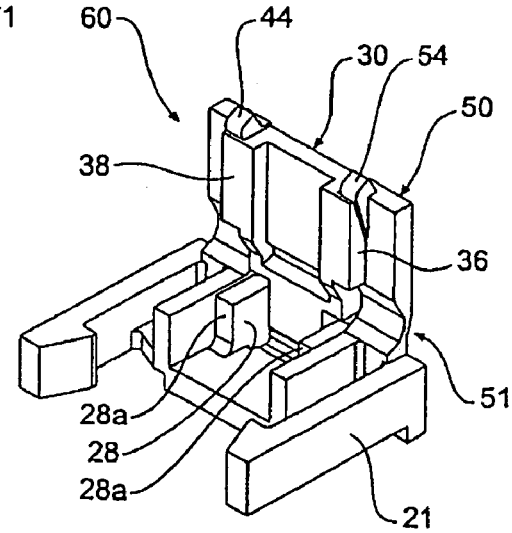
FIG. 4 shows a detailed view of a sub-assembly of FIG. 2.

Referring to FIG. 4 it can be seen that the central shutter 30 has a pair of wings 36 and 38 that actuate the side shutters 40 and 50. This arrangement of driver and driven can equally work in the opposite, that is the side shutters 40 and 50 can drive the central shutter 30.

Again referring to FIG. 4, stops 44 and 54 on the upper ends of side shutters 40 and 50 respectively can be seen. These stops engage with the body 20 to limit rotation of the shutters from there open position to the closed position. The stops 44 and 54 are specifically shaped position to ensure that the shutters close to provide a substantially flat outer face.

FIG. 4 shows how the entire sub-frame 21 can be created from a single plastic moulding. The hinges 31, 41 and 51 are created by necked regions, that is regions of plastic that are narrowed sufficiently to provide flexibility. FIG. 4 also shows abutment surfaces 28*a* formed on the rear sides of the infill portions 28. These abutment surfaces assist in retaining the plug within the open mouth of the connector 10.

A variant of the first embodiment of the invention is shown in FIGS. 7*a* and 7*b*. With this variant, the front face has a more rounded shape. In other respects, this variant is substantially the same as the embodiment shown in FIGS. 1 to 6*c*.

A second embodiment of the invention is shown in FIG. 8. With this alternative embodiment of the invention, the central shutter 30 has a pair of spaced apart protrusions 92 and 94 positioned adjacent the first hinge axis 32. The protrusions 92 and 94 present abutment surfaces to assist in retaining the plug 5 when the shutters 30, 40 and 50 are in the open position. With this embodiment of the invention, although the three shutters 30, 40 and 50 present a generally flat face, protrusions 92 and 94 interrupt the smooth face and protrude outwards.

The second embodiment of the invention also differs in that the spring 70 is more of a torsion spring. The end of the spring 70 is connected to side shutter 50. The side shutter 50 has a tab (not shown) that pushes against the rear of the central shutter 30.

The connectors described above are very easy to use. A suitable plug having a hinge tail is simply pressed into the open mouth, the plug itself pushing on the shutters to open them. Once the plug has been pressed fully into the connector, the tail springs downwards to engage the abutment surfaces 28*a* most clearly shown in FIG. 4. The plug is then retained within the connector. Removal of the plug is just as easy. All that is required is for a person to lift the tail of the plug and pull the plug out from the socket. As the plug comes out of the socket, the spring 70 acts to close the shutters as previously described above.

The embodiments described above are modular sockets. However, it should be appreciated that the invention can also apply to front plate assembly type sockets/connectors as well. Modular outlets are referred to by many names including "key stone data outlets", "30 mec outlets". Shutters according to the invention can fit to any connector or outlet including data outlets, modular or are integral with patch panels, hubs, front plates etc.

While the present invention has been described in terms of preferred embodiments in order to facilitate better understanding of the invention, it should be appreciated that various modifications can be made without departing from the principles of the invention. Therefore, the invention should be understood to include all such modifications within its scope.

The claims defining the invention are as follows:

1. A shuttered electrical connector for receiving an electrical plug, the plug having a hinged tail for lockingly engaging with the connector, the connector including:

a body defining a socket having an open mouth;

a sub-frame having a central shutter hingedly mounted to the sub-frame adjacent the open mouth for rotation about a first hinge axis;

a pair of abutment surfaces provided on the sub-frame and positioned on sides of the central shutter; and a pair of spaced apart side shutters hingedly mounted to the sub-frame adjacent the open mouth for rotation about a second hinge axis, the second hinge axis being parallel to and spaced apart from the first hinge axis, wherein the shutters are rotatable through approximately 90 degrees from a closed position in which together the shutters cover the open mouth while presenting a substantially flat outer face, to an open position receiving the plug in which the central shutter is offset from the side shutters.

2. A connector as claimed in claim 1, wherein the central shutter is T-shaped and comprises a central leg through which the first hinge axis passes.

3. A connector as claimed in claim 2, including:

a pair of infill portions mounted to the body and positioned one on each side of the central leg, wherein, when the shutters are in the closed position, the infill portions assist in covering the mouth of the socket, and when the shutters are in the open position, the infill portions present the pair of abutment surfaces to assist in retaining the plug.

4. A connector as claimed in claim 3, wherein the shutters and the infill portions are parts of a single plastic moulded sub-frame having necked regions, the necked regions functioning as hinges for the shutters.

5. A connector as claimed in claim 4, including a spring biasing the shutters towards the closed position.

6. A connector as claimed in claim 5, wherein the spring actuates the central shutter to the closed position and the central shutter actuates the side shutters to the closed position.

7. A connector as claimed in claim 6, wherein the central shutter includes at least two projecting wings, the wings being positioned such that, as the central shutter closes under actuation from the spring, the wings bear against the side shutters, thereby closing the side shutters.

8. A connector as claimed in claim 7, wherein each side shutter includes a stop, each stop being engagable with the body to limit rotation of the shutters from the open position to the closed position.

9. A connector as claimed in claim 8, wherein the spring comprises folded sheet metal having an end lip for engaging the central shutter, a curved portion, a cantilever portion and an anchor portion.

10. A connector as claimed in claim 9, wherein the connector is arranged and constructed such that the spring anchor portion rotates about a mounting point on the body, whereby rotation of the spring anchor portion reduces the stresses that would otherwise be applied to the spring.

11. A connector as claimed in claim 10, wherein the central shutter has a cleaning material attached to an end remote from the first hinge axis, the cleaning material being provided to clean electrical contacts when the shutter rotates past the contacts.

12. A connector as claimed in claim 1, wherein the central shutter has a pair of spaced apart protrusions positioned adjacent the first hinge axis, and the protrusions present the abutment surfaces to assist in retaining the plug.

13. A connector as claimed in claim 12, including a spring biasing the shutters towards the closed position.

14. A connector as claimed in claim 12, wherein the spring actuates a first of the side shutters to the closed position, the first side shutter actuates the central shutter to the closed position and the central shutter actuates a second of the side shutters to the closed position.

15. A connector as claimed in claim 12, wherein the central shutter has a cleaning material attached to an end remote from the first hinge axis, the cleaning material being provided to clean electrical contacts when the shutter rotates past the contacts.

16. A shuttered electrical connector for receiving an electrical plug, the plug having a hinged tail for lockingly engaging with the connector, the connector including:

a body defining a socket having an open mouth;

a sub-frame:

a central shutter hingedly mounted to the sub-frame adjacent the open mouth for rotation about a first hinge axis;

a pair of abutment surfaces provided on the sub-frame and positioned on sides of the central shutter:

a pair of spaced apart side shutters hingedly mounted to the sub-frame adjacent the open mouth for rotation about a second hinge axis, the second hinge axis being parallel to and spaced apart from the first hinge axis; and a spring biasing the shutters towards the closed position, wherein the shutters are rotatable through approximately 90 degrees from; a closed position in which the shutters cover the open mouth together while presenting a substantially flat outer face, to an open position receiving the plug in which the central shutter is offset from the side shutters.

17. A connector as claimed in claim 16, wherein the spring actuates the central shutter to the closed position and the central shutter actuates the side shutters to the closed position.

18. A connector as claimed in claim 17, wherein the central shutter includes at least two projecting wings, the wings being positioned such that, as the central shutter closes under actuation from the spring, the wings bear against the side shutters, thereby closing the side shutters.

19. A connector as claimed in claim 18, wherein each side shutter includes a stop, each stop being engagable with the body to limit rotation of the shutters from the open position to the closed position.

20. A connector as claimed in claim 19, wherein the spring comprises folded sheet metal having an end lip engaging the central shutter, a curved portion, a cantilever portion and an anchor portion engaging the body.

21. A connector as claimed in claim 20, wherein the connector is arranged and constructed such that the spring anchor portion rotates about a mounting point on the body, whereby rotation of the spring anchor portion reduces the stresses that would otherwise be applied to the spring.

22. A connector as claimed in claimed in claim 21, wherein the central shutter has a cleaning material attached to an end remote from the first hinge axis, the cleaning material being provided to clean electrical contacts when the shutter rotates past the contacts.

* * * * *

UNITED STATES PATENT AND TRADEMARK OFFICE

CERTIFICATE OF CORRECTION

PATENT NO. : 7,364,444 B2
APPLICATION NO. : 10/571541
DATED : April 29, 2008
INVENTOR(S) : Andrew Kellock et al.

It is certified that error appears in the above-identified patent and that said Letters Patent is hereby corrected as shown below:

In column 8 line 5 of the printed patent please replace ":" with -- ; --
In column 8 line 10 of the printed patent please replace ":" with -- ; --

Signed and Sealed this

Eleventh Day of November, 2008

JON W. DUDAS
*Director of the United States Patent and Trademark Office*